United States Patent [19]

Töpfl et al.

[11] 3,991,237

[45] Nov. 9, 1976

[54] PROCESS FOR BONDING AND PROVIDING NONWOVENS WITH AN ANTIMICROBIAL FINISH

[75] Inventors: Rosemarie Töpfl, Dornach; Christina Göthberg, Basel; Gerhard Hool, Lupsingen, all of Switzerland

[73] Assignee: Ciba-Geigy Corporation, Ardsley, N.Y.

[22] Filed: Dec. 5, 1974

[21] Appl. No.: 529,886

[30] Foreign Application Priority Data

Dec. 12, 1973 Switzerland ..... 17402/73
Dec. 12, 1973 Switzerland ..... 17404/73

[52] U.S. Cl. ..... 427/386; 427/389; 427/390 R

[51] Int. Cl.[2] ..... B05D 3/02

[58] Field of Search ..... 427/390, 391

[56] References Cited

UNITED STATES PATENTS 3,769,365 10/1973 Toepfl et al. ..... 260/834

*Primary Examiner*—Michael R. Lusignan
*Attorney, Agent, or Firm*—Joseph G. Kolodny; Edward McC. Roberts; Prabodh I. Almaula

[57] ABSTRACT

A process for bonding and providing nonwovens with an antimicrobial finish is provided, which comprises treating the nonwovens with aqueous preparations of 1. reaction products of (a) an epoxide that contains at least two epoxide groups in each molecule, (b) a fatty amine with 12 to 24 carbon atoms, (c) a dicarboxylic acid of the formula $HOOC(CH_2)_{y-1}COOH,$ wherein $y$ is an integer from 1 to 13, optionally (d) an anhydride of an aromatic dicarboxylic acid with at least 8 carbon atoms, of an aliphatic monocarboxylic acid with at least 2 carbon atoms, or of an aliphatic dicarboxylic acid with at least 4 carbon atoms, (e) an aliphatic diol with 2 to 21 carbon atoms and/or (f) a difunctional compound which differs from components (a), (c), (d) and (e), which reaction products have been reacted or mixed or reacted and mixed with
2. aminoplast precondensates which contain alkyl ether groups, and subsequently drying the treated nonwovens at elevated temperature.

The finished nonwovens show a good strength, a soft-thandle a good fastness to washing, solvents and shampooing and simultaneously good antimicrobial effects.

28 Claims, No Drawings

PROCESS FOR BONDING AND PROVIDING NONWOVENS WITH AN ANTIMICROBIAL FINISH

The present invention provides a process for bonding and providing nonwovens with an antimicrobial finish, which comprises treating the nonwovens with aqueous preparations of 1. reaction products of
   a. an epoxide that contains at least two epoxide groups in each molecule,
   b. a fatty amine with 12 to 24 carbon atoms,
   c. a dicarboxylic acid of the formula $$HOOC(CH_2)_{y-1}COOH,$$

wherein $y$ is an integer from 1 to 13, optionally
   d. an anhydride of an aromatic dicarboxylic acid with at least 8 carbon atoms, of an aliphatic monocarboxylic acid with at least 2 carbon atoms, or of an aliphatic dicarboxylic acid with at least 4 carbon atoms,
   e. an aliphatic diol with 2 to 21 carbon atoms and/or
   f. a difunctional compound which differs from components (a), (c), (d) and (e), which reaction products have been reacted or mixed or reacted and mixed with
2. aminoplast precondensates which contain akyl ether groups, and subsequently drying the treated nonwovens at elevated temperature.

The aqueous preparations used according to the invention can be solutions, but preferably they are emulsions.

The epoxides of the component (a) are derived preferably from polyhydric phenols or polyphenols, e.g. resorcinol, or phenol-formaldehyde condensation products of the type of the resols or novolaks. Bisphenols, e.g. bis-(4-hydroxyphenyl)-methane and, above all, 2,2-bis(4'-hydroxyphenyl)-propane, are especially preferred starting compounds for the manufacture of the epoxides.

Compounds to be mentioned particularly are epoxides of 2,2-bis(4'-hydroxyphenyl)-propane which have an epoxide content of 1 to 6, particularly of 1.8 to 5.8 epoxy group equivalents/kg, but preferably at least 5 epoxy group equivalent/kg, and which have the formula wherein $x$ represents an integer from 11 to 23, preferably from 17 to 21. The amines are therefore, for example, laurylamine, palmitylamine, stearylamine, arachidylamine or behenylamine. Mixtures of these amines, like those obtainable in the form of commercial products, can also be used.

Alkylenedicarboxylic acids with 2 to 14 carbon atoms have proved advantageous as component (c). These are normally dicarboxylic acids of the formula $$HOOC-(CH_2)_{y-1}COOH \qquad III$$

wherein $y$ is an integer from 1 to 13, especially 1 to 5 and preferably 6 to 13.

Examples of suitable dicarboxylic acids for component (c) are accordingly oxalic, malonic, succinic, glutaric, adipic, pimelic, suberic, azelaic or sebacic acid, nonanedicarboxylic acid, decanedicarboxylic acid, undecanedicarboxylic acid or dodecanedicarboxylic acid.

Component (c) can be used by itself or optionally together with component (d), both components complementing each other.

As component (d) there is used preferably an anhydride of a monocyclic or bicyclic aromatic dicarboxylic acid with 8 to 12 carbon atoms or of an aliphatic dicarboxylic acid with 4 to 10 carbon atoms or of a monocarboxylic acid with at least 2 to 10 carbon atoms. Anhydrides of a monocyclic aromatic dicarboxylic acid with 8 to 10 carbon atoms have proved particularly advantageous. Particular interest attaches to phthalic anhydride which is optionally substituted by methyl.

Examples of suitable anhydrides for component (d) are accordingly acetic anhydride, maleic anhydride or phthalic anhydride.

If component (e) is used concurrently for the manufacture of the reaction products, the diols in question are preferably aliphatic diols with 2 to 21, preferably 2 to 6, carbon atoms the carbon chains of which are optionally interrupted by oxygen atoms. Particular interest in this connection attaches to alkylene diols with 2 to 6 carbon atoms or diethylene or triethylene glycol or also polyethylene or polypropylene glycols. Examples of alkylenediols with 2 to 6 carbon atoms which are used with particular advantage are ethylene glycol, butanediol-1,4, neopentyl glycol or, preferably hexanediol-1,6.

As functional groups or atoms, the difunctional component (f), which is also optional, preferably contains (I)

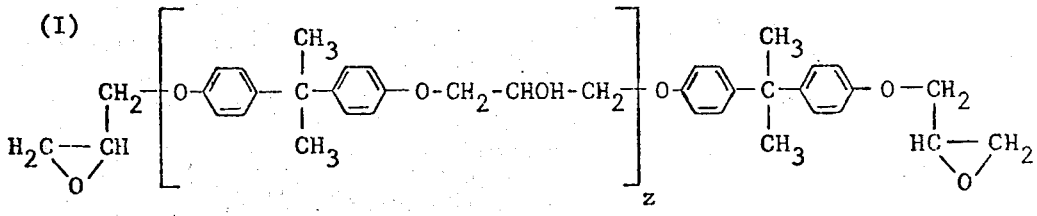

wherein $z$ represents a mean number from 0 to 6, preferably from 0 to 2.2 and optionally also from 0 to 0.65. Such epoxides are obtained by reaction of epichlorohydrin with 2,2-bis-(4'-hydroxyphenyl)-propane.

Mono-fatty amines with 12 to 24 carbon atoms have proved principally to be very suitable components (b). Usually these are amines of the formula $$H_3C-(CH_2)_x-NH_2 \qquad II$$

halogen atoms which are bonded to an alkyl radical, vinyl groups or carboxy ester groups or at most one epoxide, carboxy or hydroxy group together with another functional group or with another atom of the indicated type. In particular, these compounds are difunctional organic compounds that contain, as functional groups or atoms, alkyl-bonded chlorine or bromine atoms, vinyl groups or carboxy ester groups or at most one epoxide or carboxy group together with another functional group or another atom of the indicated type.

Particularly suitable difunctional organic compounds are aliphatic. They are, for example, epihalohydrins, such as epibromohydrin or, preferably epichlorohydrin.

Other possible difunctional compounds are, for example, glycerol dichlorohydrin, acrylic acid, methylolacrylic amide, acrylonitrile.

The aminoplast precondensates used as component (2) are desirably completely or, in particular, partially etherified methylol compounds of nitrogen-containing aminoplast formers, such as urea, thiourea, urea derivatives, e.g. ethylene urea, propylene urea or glyoxalmonourein.

Preferably, however, etherified methylolaminotriazines are used, for example alkyl ethers of highly methylolated melamine the alkyl radicals of which contain from 1 to 4 carbon atoms. Possible alkyl radicals include methyl, ethyl, n-propyl, isopropyl, n-butyl and n-hexyl radicals. In addition to such alkyl radicals, yet further radicals, for example polyglycol radicals, can also be present in the molecule. Furthermore, n-butyl ethers of a highly methylolated melamine containing 2 to 3 n-butyl groups in the molecule are preferred. By highly methylolated melamines are meant in this context those with an average of at least 5, desirably about 5,5, methylol groups.

Alkyl ethers of methylolated urea, of the cited methylolated urea derivatives or preferably of methylolated aminotriazines are particularly suitable.

The component (2) can also be present simultaneously as mixture component or exclusively as mixture component, e.g. the preparations used in the process according to the invention can contain reaction products of components (a) to (f) and (2) or mixtures of component (2) with the reaction products of components (a) to (f) and (2) or mixtures of component (2) with the reaction products of components (a) to (f).

The manufacture of the reaction products can be carried out by methods which are known per se, wherein the components are reacted with one another in varying sequence. Desirably, the components (a) and (b) or (a) and (c) are first reacted with one another. The reaction of the component (c) with the already reacted components (a) and (b) can also be effected simultaneously, if appropriate, with the components (d), (e) and (f) or with component (2).

On the one hand, it is therefore possible to react the components (a), (b) and (c) initially with one another simultaneously and subsequently, if appropriate, to react the product with the components (d), (e), (f) and (2). In this modification of the process, the components (a), (b) and (c) are reacted with one another desirably at temperatures of 80° to 120° C, preferably at 100° C, the proportions being generally so chosen that for an epoxide group equivalent of 1 there are used 0.05 to 0.7 amino group equivalent of component (b), 0.2 to 2.0, preferably 0.4 to 2.0, acid equivalents of component (c) and (d), 0.1 to 0.8, hydroxy group equivalent of component (e), 0.1 to 0.7 mole of component (f) and 10 to 80, preferably 30 to 60, percent by weight of component (2), based on the total weight of the components (a) to (f) and (2). If component (2) is used as mixture component, it can also be used in amounts of about 10 to 80, preferably 30 to 60, percent by weight, based on the total weight of the mixture of (1) and (2). The use of component (2) as mixture component without its simultaneous use as reaction component or its exclusive use as reaction component for the manufacture of the reaction products is preferred.

On the other hand, it is also possible to react initially the components (a) and (b) alone with each other and then with component (c) and optionally in a third or fourth step with component (d), (e), (f) or (2). The manufacture of the reaction products of (a) and (b) in this second modification is also desirably carried out at temperatures of 80° to 120° C, preferably at about 100° C. The reaction in the second step with component (c) is carried out desirably at 80° to 110° C, preferably at about 100° C.

The reaction with components (d), (e), (f) and (2) is carried out normally at a temperature of 60° to 100° C, preferably at about 100° C.

The reaction products that are obtained without using component (2) as reaction component can have as a rule an acid number of 5 to 100, preferably 15 to 60.

Suitable organic solvents in the presence of which the reaction products are manufactured are primarily water soluble organic solvents and desirably those that are infinitely miscible with water. Dioxan, isopropanol, ethanol and methanol, ethylene glycol-n-butyl ether (= n-butyl glycol), diethylene glycol monobutyl ether, dimethyl formamide, may be cited as examples.

Moreover, it is also possible to carry out the reaction in the presence of water-insoluble solvents, e.g. in hydrocarbons like petrol, benzene, toluene, xylene; halogenated hydrocarbons, e.g. methylene bromide, carbon tetrachloride, ethylene chloride, ethylene bromide, s-tetrachloroethane and especially also trichloroethylene.

The preparations used according to the invention contain reaction products that are manufactured using component (2) or they contain the reaction products in admixture with component (2). At least one aminoplast precondensate should be used either as reaction component (s) for the manufacture of the reaction products or as mixture component.

The preparations can contain, for example, the following reaction products or mixtures:

- reaction products of (a), (b), (c), (d), (f) and (2);
- reaction products of (a), (d), (c), (e), (f) and (2);
- mixtures of reaction products of components
  - (a), (b), (c), (d), (e), (f) and component (2);
  - (a), (b), (c), (e) and component (2);
  - (a), (b), (c), (f) and component (2).

The solids content in the preparations can be about 30 to 70 percent by weight.

The preparations are normally applied from an aqueous medium which contains the reaction products in emulsified form. To this end, the preparations of the reaction products are mixed with water and optionally with wetting agents and dispersants. The resultant stable, aqueous emulsions can have a pH of about 4 to 8, preferably 4 to 6. The solids content can be about 10 to 40 percent by weight. Examples of suitable wetting agents and dispersants are adducts of an alkyleneoxide, preferably ethylene oxide, and aliphatic or cycloaliphatic amines and alcohols of higher molecular weight or fatty acids or fatty amides which optionally may be esterified at the hydroxy groups with polybasic or organic acids or, of they are nitrogen compounds, can also be quaternised. In addition, these compounds can also be reacted with further compounds in order to obtain e.g. a cross-linking effect.

Besides the emulsified reaction products or mixtures of the reaction products and the aminoplast precondensates, the application liquors can contain still other additives, e.g. acids or salts or also other finishing or improving agents. Phosphoric, sulphuric and hydrochloric acid or also oxalic, formic and acetic acid may be cited as examples of acids.

The amount of reaction product or mixture of reaction product and aminoplast precondensate (exclusive of solvent and water), based on the substrate, is about 10 to 50, preferably 10 to 30, percent by weight for finishing and bonding nonwovens. The application is effected as a rule at 20° to 100° C, preferably at room temperature, and by known methods, for example by immersion, spraying, injecting, brushing, padding or impregnating.

The treated fibrous materials are then dried, when already a cross-linking occurs. By means of a subsequent further heat treatment, preferably at 100° to 160° C or 120° to 140° C, the cross-linking is terminated and the bonding of the nonwovens thereby achieved. As a rule, a heat treatment lasting a few minutes suffices in the indicated temperature range.

The customary textile fibres as well as also glass fibres can be used for manufacturing the nonwovens that are finished with the preparations according to the invention. Particularly suitable are nonwovens made from e.g. cotton, viscose staple fibre or synthetic polyamide, polyester, polyacrylonitrile or polypropylene fibres. Blends of these fibrous materials are also suitable.

The nonwovens finished with the preparations according to the invention have a good strength and at the same time very good handle characteristics and also good fastness to washing, solvents and shampooing. In addition to the described effects, a very good antimicrobial finish is simultaneously imparted to the substrates with the preparations according to the invention. This type of finish is particularly useful if the textile materials mentioned herein are used as floor coverings, e.g. needle felt carpets or mats, for foot grinds and surrounds of swimming baths, as wall coverings or as filter materials, e.g. as air filters, since these material are particularly subject to microbial attack, for example by bacteria and fungi.

The microbial effect is against representatives of the Gram-positive and Gram-negative bacteria, for example against *Staphylococous aureus*, *Escherichia coli* and *proteus vulgaris* or against fungi, for example *Trichophyton mentagrophytes*.

Owing to the good fastness to washing, shampooing and dry cleaning, the antimicrobial effect is therefore also retained along with the good strength and the good handle characteristics.

The following Examples illustrate the invention, the parts and percentages being by weight.

EXAMPLE 1

A mixture of 196 g of an epoxide formed from 2,2-bis-(4′-hydroxyphenyl)-propane and epichlorohydrin (1 epoxide equivalent), 108 g of stearylamine (0.4 amino group equivalent) and 100 g of butyl glycol is stirred for 15 minutes at 100° C internal temperature. Then 73 g of adipic acid (1 acid equivalent) are added thereto and stirring is continued for 3 hours at 100° C internal temperature. Upon addition of 27.8 g of epichlorohydrin (0.3 mole), stirring is continued for a further 3 hours at 100° C internal temperature. The reaction mixture is subsequently diluted with 304.8 g of perchloroethylene and a 50% resin solution is obtained. Viscosity: 7740 cP. The viscosities are measured in a "Rotavisko" viscosimeter at 20° C (measuring instrument: NV).

Acid number: 85.

360 g of the above product are mixed with 150 g of an 80% solution of hexamethylolmelamine dibutyl and tributyl ether in butanol, 72 g of a 50% aqueous solution of an adduct of hydroabietyl alcohol and 200 moles of ethylene oxide (cross-linked with 1% hexamethylene-1,6-diisocyanate) and 29 g of a 50% aqueous solution of hydroabietylamine and 70 moles of ethylene oxide. A finely disperse emulsion is obtained after addition of 389 g of water by stirring.

Resin content: 30%, pH: = 4.1.

EXAMPLE 2

A mixture of 49 g of an epoxide according to Example 1 (0.25 epoxide equivalent), 27 g of stearylamine (0.1 amino group equivalent) and 10 g of butyl alcohol is stirred for 1 hour at 100° C internal temperature. To this mixture are then added 7.8 g of neopentyl glycol (0.15) hydroxy group equivalent) and 14.8 g of succinic acid (0.25 acid equivalent). Then 7 g (0.075 mole) of epichlorohydrin are added thereto and stirring is continued for 2 hours at 100° C internal temperature. Subsequently 178 g of an 80% solution of hexamethylolmelamine dibutyl and tributyl ether in butanol, which has been diluted previously with 40 g of butyl glycol, are added over the course of 30 minutes and the reaction mixture is stirred for 1 hour at 100° C internal temperature. Dilution with 162.4 g of perchloroethylene yields a clear, 50% resin solution.

Acid number: 22.

Viscosity: 12580 cP.

400 g of the above resin solution are mixed with 48 g of a 50% aqueous solution of an adduct of hydroabietyl alcohol and 200 moles of ethylene oxide (cross-linked with 1% hexamethylene-1,6-diisocyanate) and 19 g of a 50% aqueous solution of an adduct of hydroabietylamine and 70 moles of ethylene oxide. A finely disperse emulsion is obtained after addition of 533 g of water by stirring.

Resin content: 20%, pH: 4.1.

EXAMPLE 3

A mixture of 49 g of an epoxide according to Example 1 (0.25 epoxide equivalent), 27 g of stearylamine (0.1 amino group equivalent) and 10 g of butyl glycol is stirred for 1 hour at 100° C internal temperature. To this mixture are then added 7.8 g of neopentyl glycol (0.15 hydroxy group equivalent) and 13 g of malonic acid (0.25 acid equivalent) and stirring is continued for 3 hours at 100° C internal temperature. Then 7 g of epichlorohydrin (0.075 mole) are added and stirring is again continued for 2 hours at 100° C. Subsequently 175 g of an 80% solution of hexamethylolmelamine dibutyl and tributyl ether in butanol, which has previously been diluted with 40 g of butyl glycol, are added over the course of 30 minutes and the mixture is stirred for 1 hour at 100° C internal temperature.

Dilution with 158.8 g of perchloroethylene yields a clear, 50% resin solution.

Acid number: 5.5

Viscosity: 720 cP.

400 g of the above resin solution are mixed with 48 g of a 50% aqueous solution of an adduct of hydroabietyl alcohol and 200 moles of ethylene oxide (cross-linked with 1% hexamethylene-1,6-diisocyanate) and 19 g of a 50% aqueous solution of an adduct of hydroabietylamine and 70 moles of ethylene oxide. A finely disperse emulsion is obtained after addition of 533 g of water by stirring.

Resin content: 20%, pH: 4.6.

EXAMPLE 4

A mixture of 196 g of an epoxide according to Example 1 (1 epoxide equivalent), 15.5 g of a mixture of 1-aminoeicosane and 1-aminodocosane (0.05 amino group equivalent) and 100 g of butyl glycol is stirred for 3 hours at 100° C internal temperature. To this mixture are then added 102 g of adipic acid (1.4 acid equivalents) and stirring is continued for 3 hours at 100° C internal temperature. After addition of 9.25 g (0.1 mole) of epichlorohydrin stirring is again continued for 3 hours at room temperature and the product is subsequently diluted with 222.75 g of perchloroethylene. A clear, 50% solution is obtained.

Acid number: 93.6

Viscosity: 1040 cP.

360 g of the above product are mixed with 150 g of an 80% solution of hexamethylolmelamine dibutyl and tributyl ether in butanol, 72 g of a 50% aqueous solution of an adduct of hydroabietyl alcohol and 200 moles of ethylene oxide (cross-linked with 1% hexamethylene-1,6-diisocyanate) and 29 g of a 50% aqueous solution of hydroabietylamine and 70 moles of ethylene oxide. A finely disperse emulsion is obtained after addition of 389 g of water by stirring.

Resin content: 30%, pH: 4.1.

EXAMPLE 5

A mixture of 196 g of an epoxide according to Example 1 (1 epoxide equivalent), 62 g of a mixture of 1-aminoeicosane and 1-amino-docosane (0.2 amino group equivalent) and 100 g of dimethyl formamide is stirred for 15 minutes at 100° C internal temperature. To this mixture are then added 31.2 g of neopentyl glycol (0.6 hydroxy group equivalent) and 73 g of adipic acid (1 acid equivalent) and stirring is continued for 3 hours at 100° C internal temperature. Then 27.8 g (0.3 mole) of epichlorohydrin are added and stirring is again continued for 3 hours at 100° C internal temperature. Dilution with 290 g of perchloroethylene yields a clear, 50% solution.

Acid number: 32

Viscosity: 1090 cP.

360 g of the above product are mixed with 150 g of an 80% solution of hexamethylolmelamine dibutyl and tributyl ether in butanol, 72 g of a 50% aqueous solution of an adduct of hydroabietyl alcohol and 200 moles of ethylene oxide (cross-linked with 1% hexamethylene-1,6-diisocyanate) and 29 g of a 50% aqueous solution of an adduct of hydroabietylamine and 70 moles of ethylene oxide. A finely disperse emulsion is obtained after addition of 389 g of water by stirring.

Resin content: 30%, pH: 4.5.

EXAMPLE 6

A mixture of 49 g of an epoxide according to Example 1 (0.25 epoxide equivalent), 27 g of stearylamine (0.1 amino group equivalent) and 10 g of butyl glycol is stirred for 1 hour at 100° C internal temperature. To this mixture are then added 7.8 g of neopentyl glycol (0.15 hydroxy group equivalent) and 11.25 g of anhydrous oxalic acid (0.25 acid equivalent) and stirring is continued for 3 hours at 100° C internal temperature. Then 7 g of epichlorohydrin (0.075 mole) are added and the mixture is stirred for 2 hours at 100° C internal temperature. Subsequently 175 g of an 80% solution of hexamethylolmelamine dibutyl and tributyl ether in butanol, which has previously been diluted with 80 g of butyl glycol, are added dropwise over the course of 30 minutes and stirring is again continued for 30 minutes at 100° C internal temperature. Dilution with 117 g of perchloroethylene yields a clear, 50% solution.

Acid number: 33.2

Viscosity: 6770 cP.

400 g of the above resin solution are mixed with 48 g of a 50% aqueous solution of an adduct of hydroabietyl alcohol and 200 moles of ethylene oxide (cross-linked with 1% hexamethylene-1,6-diisocyanate) and 19 g of an adduct of hydroabietylamine and 70 moles of ethylene oxide. A finely disperse emulsion is obtained after addition of 533 g of water by stirring.

Resin content: 20%, pH: 3.6.

EXAMPLE 7

A mixture of 98 g of an epoxide according to Example 1 (0.5 epoxide equivalent), 31 g of a mixture of 1-aminoeicosane and 1-amino-docosane (0.1 amino group equivalent) and 50 g of dimethyl formamide is stirred for 15 minutes at 100° C internal temperature. To this mixture are then added 15.6 g of neopentyl glycol (0.3 hydroxy group equivalent) and 50.5 g of sebacic acid (0.5 acid equivalent) and stirring is continued for 3 hours at 100° C internal temperature. Subsequently 13.9 g (0.15 mole) of epichlorohydrin are added and stirring is again continued for 3 hours at 100° C internal temperature. Dilution with 159 g of perchloroethylene yields a clear, 50% solution.

Acid number: 27.8

Viscosity: 1400 cP.

300 g of the above resin solution are mixed with 280 g of an 80% solution of hexamethylolmelamine dibutyl and tributyl ether in butanol, 90 g of a 50% aqueous solution of an adduct of hydroabietyl alcohol and 200 moles of ethylene oxide (cross-linked with 1% hexamethylene-1,6-diisocyanate) and 36 g of a 50% aqueous solution of an adduct of hydroabietylamine and 70 moles of ethylene oxide. A finely disperse emulsion is obtained after addition of 6.25 g of diammonium phosphate in 537 g of water by stirring.

Resin content: 30%, pH: 4.9.

EXAMPLE 8

A mixture of 49 g of an epoxide according to Example 1 (0.25 epoxide group equivalent) 27 g of stearylamine (0.1 amino group equivalent) and 50 g of butyl glycol is stirred for 1 hour at 100° C internal temperature. To this mixture are then added 7.8 g of neopentyl glycol (0.15 hydroxy group equivalent) and 25.2 g of sebacic acid (0.25 acid equivalent) and stirring is continued for 3 hours at 100° C internal temperature. Subsequently 7 g of epichlorohydrin (0.075 mole) are added and stirring is again continued for 2 hours at 100° C internal temperature.

Then 196 g of an 80% solution of hexamethylolmelamine dibutyl and tributyl ether in butanol are added and stirring is again continued for 1 hour at 100° C internal temperature. Dilution with 183 g of perchloroethylene yields a clear, 50% resin solution.

Acid number: 24

Viscosity: 3570 cP.

500 g of the above 50% resin solution are mixed with 60 g of a 50% aqueous solution of an adduct of hydroabietyl alcohol and 200 moles of ethylene oxide (cross-linked with 1% hexamethylene-1,6-diisocyanate) and 24 g of a 50% aqueous solution of an adduct of hydroabietylamine and 70 moles of ethylene oxide. A finely disperse emulsion is obtained after addition of 668 g of water by stirring.

Resin content: 20%, pH: 5.1.

EXAMPLE 9

180 g of the 50% resin solution described in Example 7 are mixed with 262 g of an 80% solution of hexamethylolamine dibutyl and tributyl ether in butanol, 72 g of a 50% aqueous solution of an adduct of hydroabietyl alcohol and 200 moles of ethylene oxide (cross-linked with 1% hexamethylene-1,6-diisocyanate) and 28 g of a 50% aqueous solution of an adduct of hydroabietylamine and 70 moles of ethylene oxide.

A finely disperse emulsion is obtained after addition of a solution of 4.8 g of diammonium phosphate in 453.2 g of water by stirring.

Resin content: 30%, pH: 4.9.

EXAMPLE 10

A mixture of 49 g of an epoxide according to Example 1 (0.25 epoxide equivalent), 27 g of stearylamine (0.1 amino group equivalent) and 50 g of butyl glycol is stirred for 1 hour at 100° C internal temperature. To this mixture are then added 15.2 g of sebacic acid (0.15 acid equivalent) and 4.9 g of maleic anhydride (0.1 acid equivalent) and stirring is continued for 3 hours at 100° C internal temperature. Then 7 g of epichlorohydrin (0.075 mole) are added and stirring is continued for 1 hour at 100° C internal temperature.

Subsequently 174 g of an 80% solution of hexamethylolmelamine dibutyl and tributyl ether in butanol, which has been diluted previously with 50 g of butyl glycol, are added dropwise over the course of 30 minutes and the mixture is stirred for 1 hour at 100° C internal temperature. Dilution with 108 g of perchloroethylene yields a clear, 50% solution.

Acid number: 21.2

Viscosity: 2870 cP.

400 g of the above product are mixed with 48 g of a 50% aqueous solution of an adduct of hydroabietyl alcohol and 200 moles of ethylene oxide (cross-linked with 1% hexamethylene-1,6-diisocyanate) and 19 g of a 50% aqueous solution of an adduct of hydroabietylamine and 70 moles of ethylene oxide. A finely disperse emulsion is obtained after addition of 533 g of water by stirring.

Resin content: 20%, pH: 4.9.

EXAMPLE 11

With stirring 240 g of the 50% resin solution described in Example 7 are mixed with 224 g of an 80% solution of hexamethylolmelamine dibutyl and tributyl ether in butanol and the mixture is diluted with 136 g of perchloroethylene to give a clear resin solution of medium viscosity.

EXAMPLE 12

A mixture of 57.7 g of an epoxide according to Example 1 (0.125 epoxide equivalent), 9.25 g of dodecylamine (0.05 amino group equivalent), 14.45 g of dodecanedicarboxylic acid (0.125 acid equivalent) and 30 g of butyl glycol is stirred for 4 hours at 100° C internal temperature. To this mixture are then added 2 g of acrylonitrile (0.0375 mole) and stirring is again continued for 1 hour at 100° C internal temperature. Subsequently 141.5 g of a 75% solution of hexamethylolmelamine dibutyl and tributyl ether in butanol, which has been diluted previously with 50 g of butyl glycol, are added dropwise and stirring is continued for a further 30 minutes at 100° C internal temperature. The reaction product is then diluted with 74 g of perchloroethylene to give a clear, 50% solution.

Acid number: 17.8

Viscosity: 1080-1070 cP.

200 g of the above product are mixed with 34 g of a 50% aqueous solution of an adduct of hydroabietyl alcohol and 200 moles of ethylene oxide (cross-linked with 1% hexamethylene-1,6-diisocyanate). A finely disperse emulsion is obtained after addition of 99 g of water by stirring.

Resin content: 30%, pH: 5.6.

EXAMPLE 13

A mixture of 49 g of an epoxide according to Example 1 (0.25 epoxide group equivalent), 27 g of stearylamine (0.1 amino equivalent) and 25 g of butyl glycol is stirred for 1 hour at 100° C internal temperature. To this mixture are then added 8.85 g of 1,6-hexanediol (0.15 hydroxy group equivalent) and 25.2 g of sebacic acid (0.25 acid equivalent) and stirring is continued for 3 hours at 100° C internal temperature. Subsequently 199 g of a 75% solution of hexamethylolmelamine dibutyl and tributyl ether, which has been diluted previously with 60 g of butyl glcyol, are added dropwise over the course of 40 minutes and then stirring is continued for a further 30 minutes at 100° C internal temperature. Dilution with 131 g of perchloroethylene yields a clear, 50% resin solution.

Acid number: 24.5

Viscosity: 1080–975 cP.

500 g of the above product are mixed with 85 g of a 50% aqueous solution of an adduct of hydroabietyl alcohol and 200 moles of ethylene oxide (cross-linked with 1% hexamethylene-1,6-diisocyanate). A finely disperse emulsion is obtained after addition of 248 g of water by stirring.

Resin content: 30%, pH: 4.5.

EXAMPLE 14

A mixture of 49 g of an epoxide according to Example 1 (0.25 epoxide equivalent), 27 g of stearylamine (0.1 amino group equivalent) and 25 g of butyl glycol is stirred for 1 hour at 100° C internal temperature. To this mixture are then added 15.2 g of sebacic acid (0.15 acid equivalent) and 7.4 g of phthalic anhydride (0.1 acid equivalent) and stirring is continued for 3 hours at 100° C internal temperature. Then 4 g of acrylonitrile (0.075 mole) are added and stirring is continued again for 1 hour at 100° C. Subsequently 174 g of a 75% solution of hexamethylolmelamine dibutyl and tributyl ether in butanol, which has been diluted previously with 50 g of butyl glycol, are added dropwise over the course of 30 minutes at 100° C internal temperature.

Dilution with 114.4 g of perchloroethylene yields a clear, 50% resin solution.

Acid number: 40.5

Viscosity: 2400-2200.

450 g of the above product are mixed with 76.5 g of a 50% aqueous solution of an adduct of hydroabietylamine and 200 moles of ethylene oxide (cross-linked with 1% hexamethylene-1,6-diisocyanate). A finely disperse emulsion is obtained after dilution with 223.5 g of water of stirring.

Resin content: 30%, pH: 4.8.

EXAMPLE 15

A mixture of 61.5 g of an epoxide according to Example 1 (0.0625 epoxide equivalent), 6.75 g of stearylamine (0.025 amino group equivalent) and 25 g of butyl glycol is stirred for 1 hour at 100° C internal temperature. To this mixture are then added 1.95 g of neopentyl glycol (0.0375 hydroxy group equivalent) and 6.3 g of sebacic acid (0.063 acid equivalent) and stirring is continued for 1 hour at 100° C internal temperature. Subsequently 132.5 g of a 75% solution of hexamethylolmelamine dibutyl and tributyl ether in butanol, which has been diluted previously with 50 g of butyl glycol, are added dropwise over the course of 30 minutes and stirring is coninued for 30 minutes at 100° C internal temperature. Dilution with perchloroethylene yields a clear, 50% resin solution.

Acid number: 15.8

Viscosity: 31520–30500 cP.

200 g of the above product are mixed with 34 g of a 50% aqueous solution of an adduct of hydroabietyl alcohol and 200 moles of ethylene oxide (cross-linked with 1% hexamethylene-1,6-diisocyanate). A finely disperse emulsion is obtained after addition of 166 g of water by stirring.

Resin content: 25% pH: 5.4.

EXAMPLE 16

A mixture of 61.25 g of an epoxide according to Example 1 (0.125 epoxide equivalent), 13.5 g of stearylamine (0.05 amino group equivalent) and 25 g of butyl glycol is stirred for 1 hour at 100° C internal temperature. To this mixture are then added 12.6 g of sebacic acid (0.125 acid equivalent) and stirring is continued for 3 hours at 100° C internal temperature. Then 2 g of acrylonitrile (0.0375 mole) are added and the mixture is stirred for 1 hour at 100° C internal temperature. Subsequently 152 g of a 75% solution of hexamethylolmelamine dibutyl and tributyl ether in butanol, which has been diluted previously with 65 g of butyl glycol, are added dropwise over the course of 30 minutes and stirring is continued for a further 30 minutes at 100° C internal temperature. Dilution with 75 g of perchloroethylene yields a clear, 50% resin solution.

Acid number: 27.6

Viscosity: 5400 cP.

300 g of the above product are mixed with 52 g of a 50% aqueous solution of an adduct of hydroabietyl alcohol and 200 moles of ethylene oxide (cross-linked with 1% hexamethylene-1,6-diisocyanate). A finely disperse emulsion is obtained after addition of 248 g of water by stirring.

Resin content: 25%, pH: 5.0.

EXAMPLE 17

A polyamide needle felt carpet is impregnated with the following liquor:

| | | |
|---|---|---|
| 500 | g | of the preparation according to Example 4 (30%) |
| 500 | g | of water |
| 1000 | g | |

Impregnation is effected on a padder adjusted to a roller pressure at which a liquor pick-up of about 100% is attained (corresponding to a solids pick-up of about 15%). The speed of the goods is about 2 m/min. The goods are dried over 15 to 20 minutes at 140° C.

This needle felt carpet has good resistance to rubbing. Analogous results are also obtained with the preparations according to Examples 1 to 3, 5, 6 and 8 to 11.

In analogous manner, needle felt carpets of polypropylene and polyester fibrous material are padded with the preparation according to Example 1 at room temperature and subsequently dried for 15 minutes at 120° C (polypropylene) and 140° C (polyester). A number of samples are treated for 15 minutes in trichloroethylene (dry cleaning) or shampooed 5 times.

These finished sample carpets are tested in the agar diffusion test (AATCC test method 90-1970, modified) and in the disinfection test (AATCC test method 100-1970, modified) for their resistance to the following test organisms:

| | |
|---|---|
| bacteria: | Staphylococcus aureus SG 511 |
| | Escherichia coli NCTC 8196 |
| | Proteus vulgaris NCIB 4175 |
| fungi: | Trichophyton mentagrophytes ATCC 9533. |

1. Agar Diffusion Test (Inhibition Test).

Test samples in the form of round discs measuring 2 cm in diameter are punched from the sample carpets. Sterile AATCC bact. Agar BBL (5ml) is then poured into a petri dish. After the agar layer has set, the test samples are laid in the dish with their top sides resting on this agar layer. Then 10 ml of the same nutrient medium, which is inoculated with test microorganisms, is poured over the samples.

The inoculation is effected by adjusting overnight cultures of the test microorganisms in Difco brain-heart-infusion broth by dilution with sterile broth in such a way that, after addition of the inoculum to the agar, the concentration of the microorganisms is $5 \cdot 10^5 - 1 \cdot 10^6$ per ml of agar. The dishes are then incubated for 24 hours at 37° and the inhibition zones are subsequently read off.

A similar procedure is carried out with the test microorganism Trichophyton mentagrophytes ATCC 9533. The deviations from the described procedure are:

The inoculum is prepared by elutriating an at least 7 day old slant agar culture on Mycosel Agar BBL with 10 ml of Mycophil Broth BBL, filtering it through sterile glass wool and adding it to the agar. The microorganism concentration is adjusted to about $5 \cdot 10^4 - 1 \cdot 10^6$ spores per ml of agar. The test nutrient medium used in the petri dish for Trichophyton was Mycosel Agar BBL. These dishes are incubated for 7 days at 28° C.

2. Disinfection Test

Test samples in the form of round discs (diameter 2 cm) are punched from the sample carpets under investigation and sterilised with ethylene oxide. The sterilised samples are then inoculated with the test microorganisms using 10 drops of a suspension per sample. The suspension for the inoculum is prepared in the same way as that described for the agar diffusion test and by diluting in such a way that in the end effect the following microorganism concentrations are present on the test samples:

bacteria $10^6 - 10^7$ microorganisms per sample and Trichophyton app. $5 \cdot 10^5$ spores per sample.

The inoculated samples are put into a humid chamber and incubated for 24 hours at 37° C (for Trichophyton at 28° C). Following the incubation in the humid chamber, the samples are extracted in 20 ml of phosphate buffer (pH 7.4) with the addition of 1% TWEEN-80. After the extraction, 1 ml at a time of the solution is mixed with 9 ml of AC-Agar Difco or Mycosel Agar Difco (for Trichophyton) and poured into dishes. For the agar, 1% TWEEN-80 is once again added as blocking agent. These dishes are incubated for 24 hours at 37° C (in the case of Trichophyton for 7 days at 28° C). The germ counts are then taken, comparisons are made with corresponding controls, and any microstatic after-effects in the dishes (as a consequence of insufficient blocking) are prevented by reinoculation.

| | | |
|---|---|---|
| 500 | g | of the preparation according to Example 7 |
| 500 | g | of water |
| 1000 | g | |

Needle felt carpets of polypropylene and polyester fibrous material are padded at room temperature with the same preparation and subsequently dried for 15 minutes at 120° C (polypropylene) and at 140° C (polyester). The application of reaction product, based on the weight of the substrate, is 11 to 28%.

A number of samples are treated for 15 minutes in trichloroethylene (dry cleaning) or shampooed 5 times.

These finished sample carpets are tested in the agar diffusion test (AATCC test method 90-1970, modified) and in the disinfection test (AATCC test method 100-1970, modified) for their resistance to the following test organisms:

| | |
|---|---|
| bacteria: | Staphylococcus aureus SG 511 |
| | Escherichia coli NCTC 8196 |
| | Proteus vulgaris NCIB 4175 |
| fungi: | Trichophyton mentagrophytes ATCC 9533 |

Results

| Fibrous material (felt-carpets) | Pick-up of substance in % by weight based on substrate | Drying temperature | After treatment | Antimicrobial effects |
|---|---|---|---|---|
| polyamide | 15% | 140° C | — | very good action against Trichophyton (fungistatic, fungicide) and good action against bacteria (microbistatic, microbicidal) |
| | 15% | 140° C | trichloroethylene | " |
| | 15% | 140° C | shampooed | " |
| polypropylene | 11% | 120° C | — | good action against Trichophyton (fungistatic, fungicidal) |
| | 20% | 120° C | — | very good effects against Trichophyton (fungistatic, fungicidal), good action against bacteria (bacteriostatic) |
| | 19% | 120° C | trichloroethylene | very good effects against Trichophyton (fungistatic, fungicidal), good action against bacteria (bacteriostatic, bacteriocidal) |
| | 19% | 120° C | shampooed | " |
| polyester | 15% | 140° C | — | slight action against Trichophyton (fungistatic) |
| | 28% | 120° C | — | very good action against Trichophyton (fungistatic, fungicidal), good effects against bacteria (bacteriostatic, bacteriocidal) |
| | 23% | 140° C | trichloroethylene | good action against Trichophyton (fungistatic) |
| | 25% | 140° C | shampooed | good action against Trichophyton (fungistatic, fungicidal) |
| | 24% | 140° C | — | good action against Trichophyton (fungistatic) |

The described tests are used to determine whether the test microorganisms are inhibited in their growth (microbiostatic effect) or whether they are destroyed (microbiocidal effect).

The finished felt carpets exhibit good antimicrobial effects.

EXAMPLE 18

A polyamide needle felt carpet is impregnated according to Example 17 with the following liquor:

Similarly good results on the cited fibrous materials are also obtained with the products of Examples 8 and 9. Inspection of the antimicrobial activity after the finished substrates have been stored for 1 year shows that the bactericidal action against the cited bacteria and the fungicidal action against the test fungus is retained.

EXAMPLE 19 a. A viscose rayon staple nonwoven fabric (staple leghth 70 mm, 3.5 denier) is padded at room temperature with 15% emulsions according to Examples 7 and 12 to 16 and subsequently dried for 5 minutes at 120° to 140° C. The bonded web has a very good handle without any hardening effects. The elongation (in %) and the tear length (in km) are determined. These properties are also retained after washing (15 minutes at 80° C in a 400 ml liquor containing 0.8 g of a commercial detergent) or cleaning (15 minutes in trichloroethylene).

| Example | application | tear length | elongation | resistance to water | resistance to cleaning |
|---|---|---|---|---|---|
| 7 | 16 % | 0.85 km | 17 % | good | good |
| 12 | 16 % | 1.8 km | 15 % | good | good |
| 13 | 16 % | 0.7 km | 10 % | good | good |
| 14 | 17 % | 0.9 km | 10 % | good | good |
| 15 | 18 % | 1.1 km | 11 % | good | good |
| 16 | 21 % | 0.9 km | 9 % | good | good |

b. A polyester nonwoven fabric (staple length 65 mm, 4.0 denier) is padded at room temperature with a 15 % emulsion according to Examples 7 and 12 to 16. The bonded web has a very good handle practically without hardening effects. These properties are also retained after washing or cleaning as under (a).

| Example | application | tear length | elongation | resistance to water | resistance to cleaning |
|---|---|---|---|---|---|
| 7 | 20 % | 0.96 km | 47 % | good | good |
| 12 | 24 % | 1.7 km | 56 % | good | good |
| 13 | 20 % | 1.8 km | 56 % | good | good |
| 14 | 20 % | 1.6 km | 56 % | good | good |
| 15 | 24 % | 1.9 km | 49 % | good | good |
| 16 | 20 % | 1.4 km | 53 % | good | good |

c. Needle felt carpets of polyamide material (polyhexamethylene adipic amide) are padded at room temperature with 15 % aqueous emulsions according to Examples 7 and 12 to 16 and subsequently dried for 15 minutes at 140° C.

The finished carpeting is tested in the following manner for its resistance to rubbing:

a. after the finishing
b. after 5 shampoos (aqueous detergent foam, liquor ratio:1:10)
c. after solvent treatment (10 minutes in trichloroethylene).

The samples are rubbed with a polyurethane stopper (diameter 15 mm at a stress of 500 g) 400 times in two directions.

| Example | Application | resistance to rubbing a) | b) | c) |
|---|---|---|---|---|
| 7 | 15 % | good | good | good |
| 12 | 13.9 % | good | good | good |
| 13 | 10.9 % | fairly good | good | good |
| 14 | 11.1 % | good | good | good |
| 15 | 15 % | good | good | fairly good |
| 16 | 15 % | fairly good | good | fairly good |

The webs and carpets finished according to (a) to (c) possess good antimicrobial properties (tests as described in Example 17).

We claim:

1. A process for bonding and providing nonwovens with an antimicrobial finish, which comprises treating the non-wovens with aqueous preparations of 1. reaction products of a. an epoxide that contains at least two epoxide groups in each molecule,
b. a fatty amine with 12 to 24 carbon atoms,
c. a dicarboxylic acid of the formula $$HOOC(CH_2)_{y-1}COOH,$$

wherein $y$ is an integer from 1 to 13, optionally d. an anhydride of an aromatic dicarboxylic acid with at least 8 carbon atoms, of an aliphatic monocarboxylic acid with at least 2 carbon atoms, or of an aliphatic dicarboxylic acid with at least 4 carbon atoms,
e. an aliphatic diol with 2 to 21 carbon atoms and/or
f. a difunctional compound which differs from components (a), (c), (d) and (e), which reacted products have been reacted or mixed or reaction and mixed with 2. aminoplast precondensates which contain alkyl ether groups, and subsequently drying the treated nonwovens at elevated temperature.

2. A process according to claim 1, which comprises treating the nonwovens with preparations of reaction products of components (a), (b), (c), (d), (e), (f) and (2).

3. A process according to claim 1, which comprises treating the nonwovens with preparations of reaction products of components (a), (b), (c), (f) and (2).

4. A process according to claim 1, which comprises treating the nonwovens with preparations of mixtures of reaction products of components (a), (b), (c), (d), (e) and (f); (a), (b), (c) and (e) or (a), (b), (c) and (f) and component (2).

5. A process according to claim 1, which comprises treating the nonwovens with preparations of reaction products in which the component (a) is an epoxide which is derived from a bisphenol.

6. A process according to claim 5, which comprises treating the nonwovens with preparations of reaction products in which the component (a) is a polygylcidyl ether of 2,2-bis-(4'-hydroxyphenyl)-propane with an epoxide content of 1 to 6 epoxide group equivalents per kilogram.

7. A process according to claim 5, which comprises treating the nonwovens with preparations of reaction products in which the component (a) has an epoxide of at least 5 epoxide group equivalents per kilogram.

8. A process according to claim 5, which comprises treating the nonwovens with preparations of reaction products in which the component (a) is a reaction product of epichlorohydrin and 2,2-bis-(4'-hydroxyphenyl)-propane.

9. A process according to claim 1, which comprises treating the nonwovens with preparations of reaction products in which the component (b) is a mono-fatty amine with 16 to 22 carbon atoms.

10. A process according to claim 1, which comprises treating the nonwovens with preparations of reaction products in which the component (c) is a dicarboxylic acid of the formula $$HOOC(CH_2)_{y-1}COOH,$$

wherein $y$ is a whole number from 6 to 13.

11. A process according to claim 1, which comprises treating the nonwovens with preparations of reaction products in which the component (d) is an anhydride of a monocyclic or bicyclic aromatic dicarboxylic acid with 8 to 12 carbon atoms or of an aliphatic dicarboxylic acid with 4 to 10 carbon atoms.

12. A process according to claim 1, which comprises treating the nonwovens with preparations of reaction products in which the component (d) is an anhydride of a monocarboxylic acid with 2 to 10 carbon atoms.

13. A process according to claim 11, which comprises treating the nonwovens with preparations of reaction products in which the component (d) is an anhydride of a monocyclic aromatic dicarboxylic acid with 8 to 10 carbon atoms.

14. A process according to claim 13, which comprises treating the nonwovens with preparations of reaction products in which the component (d) is a phthalic anhydride which is optionally substituted by methyl.

15. A process according to claim 1, which comprises treating the nonwovens with preparations of reaction products in which the component (e) is an aliphatic diol with 2 to 6 carbon atoms the carbon chain of which is optionally interrupted by oxygen atoms.

16. A process according to claim 15, which comprises treating the nonwovens with preparations of reaction products in which the component (e) is an alkylene diol with 2 to 6 carbon atoms or is diethylene or triethylene glycol.

17. A process according to claim 1, which comprises treating the nonwovens with preparations of reaction products in which the component (f) is a difuctional organic compound which contains as functional groups or atoms halogen atoms bonded to an alkyl radical, vinyl groups or carboxylic acid ester groups or at most one epoxide, carboxy or hydroxy group together with another functional group or another atom of the indicated kind.

18. A process according to claim 17, which comprises treating the nonwovens with preparations of reaction products in which the component (f) is a difunctional organic compound which contains as functional groups or atoms chlorine or bromine atoms bonded to an alkyl radical, vinyl groups or carboxylic acid alkyl ester groups or at most one epoxide or carboxy group together with another functional group or another atom of the indicated kind.

19. A process according to claim 18, which comprises treating the nonwovens with preparations of reaction products in which the component (f) is an epihalohydrin.

20. A process according to claim 1, which comprises treating the nonwovens with preparations of reaction products in which the component (2) is an alkyl ether of methylolated urea, methylolated urea derivatives or, preferably, of methylolated amino-triazines.

21. A process according to claim 20, which comprises treating the nonwovens with preparations of reaction products in which the component (2) is an alkyl ether of a highly methylolated melamine the alkyl radicals of which contain 1 to 4 carbon atoms.

22. A process according to claim 21, which comprises treating the nonwovens with preparations of reaction products in which the component (2) contains a n-butyl ether of a highly methylolated melamine which contains 2 to 3 n-butyl radicals in the molecule.

23. A process according to claim 1, which comprises treating the nonwovens with preparations of reaction products or mixture of (1) 1 epoxide equivalent of component (a), 0.05 to 0.7 amino group equivalent of component (b), 0.2 to 2.0 acid equivalents of component (c) and (d), optionally 0.1 to 0.8 hydroxy group equivalent of component (e), 0.1 to 0.7 mole of component (f) and 10 to 80 percent by weight of component (2), based on the total weight of components (a) to (f) and (2) or on the weight of the mixture of (1) and (2), the component (2) being used as reaction component or as mixture component or as both.

24. A process according to claim 23, which comprises treating the nonwovens with preparations of mixtures of (1) and (2) in a weight ratio of (90 to 20): (10 to 80).

25. A process according to claim 1 which comprises the use of aqueous solutions or emulsions as preparations.

26. A process according to claim 1 which comprises treating the nonwovens at 20° to 100° C, preferably at room temperature.

27. A process according to claim 1, which comprises drying the treated non-wovens at 100° to 160° C, preferably at 120° to 140° C.

28. The nonwovens which are bonded and provided with an antimicrobial finish according to the process of claim 1.

* * * * *